US008028818B2

(12) United States Patent
Kupetz et al.

(10) Patent No.: US 8,028,818 B2
(45) Date of Patent: Oct. 4, 2011

(54) CONVEYOR-TYPE DISHWASHER WITH A SLIP-FREE SHORT STROKE

(75) Inventors: Joachim Kupetz, Berghaupten (DE); Engelbert Ecker, Offenburg (DE)

(73) Assignee: MEIKO Maschinenbau GmbH & Co. KG, Offenburg (DE)

( * ) Notice: Subject to any disclaimer, the term of this patent is extended or adjusted under 35 U.S.C. 154(b) by 84 days.

(21) Appl. No.: 11/915,848

(22) PCT Filed: Mar. 23, 2006

(86) PCT No.: PCT/EP2006/002676

§ 371 (c)(1),
(2), (4) Date: Feb. 9, 2009

(87) PCT Pub. No.: WO2006/114170

PCT Pub. Date: Nov. 2, 2006

(65) Prior Publication Data

US 2009/0173597 A1 Jul. 9, 2009

(30) Foreign Application Priority Data

Apr. 28, 2005 (DE) ..... 10 2005 019 879

(51) Int. Cl.
*B65G 47/34* (2006.01)

(52) U.S. Cl. ..... 198/468.9; 198/468.1

(58) Field of Classification Search ..... 198/468.9, 198/468.1, 774.1, 775
See application file for complete search history.

(56) References Cited

U.S. PATENT DOCUMENTS 3,384,097 A * 5/1968 Fox et al. ..... 134/46
3,414,114 A * 12/1968 Fox ..... 198/729
3,565,239 A * 2/1971 Holloway et al. ..... 198/803.14
3,724,636 A * 4/1973 Wright ..... 134/140
3,788,460 A * 1/1974 Messersmith ..... 198/744
4,042,093 A * 8/1977 Fujii et al. ..... 198/339.1
4,194,614 A * 3/1980 Hrivnak ..... 198/468.1
4,228,813 A * 10/1980 Noren ..... 134/47
4,410,081 A * 10/1983 Weihe, Jr. ..... 198/725
4,518,078 A * 5/1985 Garrett ..... 198/775
4,600,099 A * 7/1986 Peddinghaus ..... 198/744
4,629,057 A * 12/1986 Jensen et al. ..... 198/418.6
RE32,804 E * 12/1988 Mason ..... 198/774.1
5,816,798 A * 10/1998 Strohmaier ..... 432/121

(Continued)

FOREIGN PATENT DOCUMENTS

DE 19829650 A1 * 1/2000

(Continued)

*Primary Examiner* — Joseph A Dillon, Jr.
(74) *Attorney, Agent, or Firm* — Muncy, Geissler, Olds & Lowe, PLLC

(57) ABSTRACT

The invention relates to a method for transporting a transportation rack (12) through a conveyor-type dishwasher which has a plurality of treatment zones by means of transportation catches (10) which are accommodated on transportation rails (5, 6). The transportation catches (10) transport transportation racks (12) in the conveying direction (1.1), with the transportation rails (5, 6) being driven by means of a rotary shaft (3). The transportation catches (10) pivot (11) about a shaft (8), which runs parallel to the conveying direction (1.1), during a forward stroke (VH) of the transportation rails (5, 6) and during the return stroke (RH) of said transportation rails. The invention also relates to a conveyor-type dishwasher comprising transportation rails (5, 6) on which transportation catches (10) are held. The transportation catches (10) are mounted such that they can pivot on shafts (8) which are oriented parallel to the conveying direction (1.1) of the transportation rack (12).

10 Claims, 5 Drawing Sheets

U.S. PATENT DOCUMENTS

| | | | | |
|---|---|---|---|---|
| 5,906,266 | A * | 5/1999 | Bungter et al. | 198/774.1 |
| 6,637,586 | B1 * | 10/2003 | Kuecker et al. | 198/774.2 |
| 6,955,179 | B2 * | 10/2005 | Ecker et al. | 134/134 |
| 7,097,023 | B1 * | 8/2006 | Chen | 198/466.1 |
| 2004/0094185 | A1 * | 5/2004 | Fransson | 134/25.2 |

FOREIGN PATENT DOCUMENTS

| | | | |
|---|---|---|---|
| EP | 0 917 277 | A1 | 5/1999 |
| WO | WO 2004/019748 | A1 | 3/2004 |
| WO | WO 2004/045361 | A1 | 6/2004 |

* cited by examiner

Figure 2:
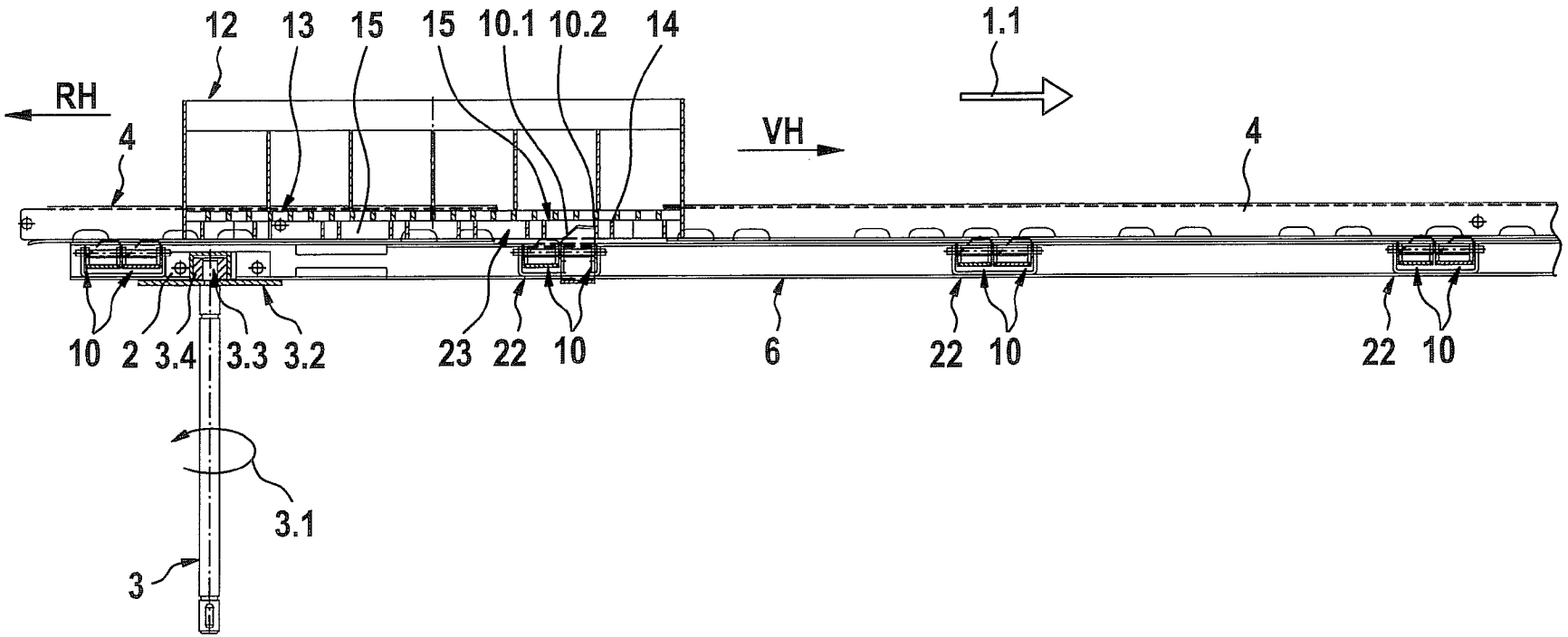

Fig. 2.1
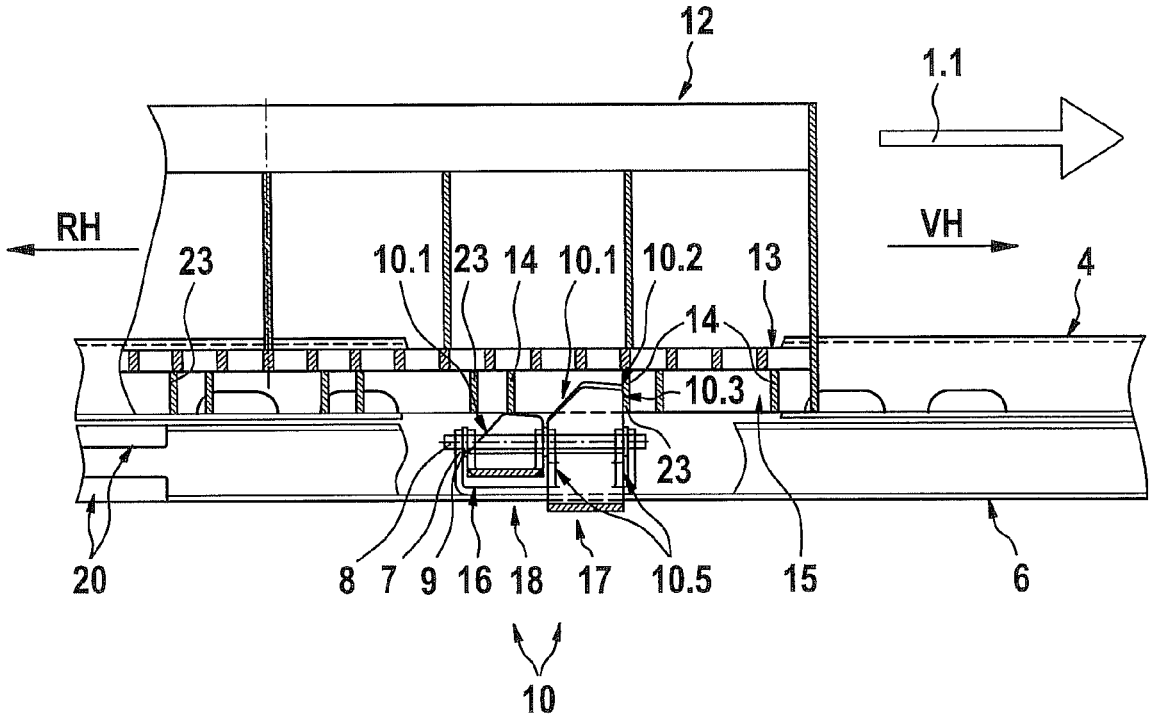

CONVEYOR-TYPE DISHWASHER WITH A SLIP-FREE SHORT STROKE

TECHNICAL FIELD

The invention relates to a conveyor-type dishwasher in which the carrier racks which hold the dishes to be cleaned are conveyed through the conveyor-type dishwasher by means of a transportation mechanism which comprises a transportation carriage. Carrier racks which make it possible for the items to be cleaned to be easily transported even outside the machine on conveyor belts or curves can be employed in conveyor-type dishwashers. The items to be cleaned can be easily inserted into the carrier racks and also be easily removed from said carrier racks again. During low-load periods, that is to say with only a small amount of dishes, the items to be cleaned can in first instance be collected in a plurality of carrier racks, with the result that the conveyor-type dishwasher can be operated cost-effectively, that is to say only when the carrier racks are fully loaded.

PRIOR ART

Lateral rack guide rails which extend in the longitudinal direction and are fitted in the machine interior ensure that the carrier racks which hold the items to be cleaned are transported through the conveyor-type dishwasher. The carrier rack rests on said rack guide rails. A transportation element which is of carriage-like design and is provided with tilting catches is located beneath the rack guide rails. These tilting catches pivot in the transportation direction of the carrier rack. The tilting catches automatically rotate into a certain position on account of their configuration and mounting, with the result that the tips of the tilting catches, after they have been moved into the upright position, project into spaces in a ribbed arrangement which is formed on the lower face of a carrier rack. During rotation, the tips of the tilting catches describe the movement of an arc of a circle. The tilting catches may be configured, for example, in the manner of a barb and, during a forward movement of a carriage-like transportation element, push the carrier rack forward after they have engaged in the lower ribbed arrangement of the carrier rack. When the carriage-like transportation element executes a backward movement, the tilting catches which are mounted such that they can rotate in the transportation direction can move away downward beneath the ribbed arrangement of the carrier rack until they can move into the upright position again in a rib space on the lower face of the carrier rack. The tips of the tilting catches describe the arc of a circle during this rotary movement into the upright position too. This means that the carrier rack remains stationary during the backward movement of the carriage-like transportation element. In the case of a renewed forward movement of the carriage-like transportation element, the tilting catches engage, after they have moved from the dipped position into the upright position again, in the ribbed arrangement of the carrier rack again and push the carrier rack forward in the transportation direction of the items to be cleaned through the conveyor-type dishwasher.

Popular designs of a carriage-like transportation element are provided by a single stroke-executing carriage which is arranged centrally between the rack guide rails, with the tilting catches which rotate in the transportation direction engaging in the center of the carrier rack. Other design variants involve providing a rigid rectangular frame, of which the two carriage profiles which are provided with the tilting catches which rotate in the transportation direction engage on the outer edges of the carrier rack. The carriage profiles extend laterally in the region of the head guide rails in the longitudinal direction of the conveyor-type dishwasher. The forward and backward movement of the carriage-like transportation element is produced by the rotary movement of a gear motor being converted into a forward and backward movement of the carriage-like transportation element by means of a crank mechanism. On account of this design principle, the carrier rack, together with the items to be cleaned which are located therein, is not conveyed through the conveyor-type dishwasher at a uniform transportation speed, but it can be transported only during a half motor revolution and remains stationary during the other half motor revolution when the carriage-like transportation element executes a movement which runs in the backward direction. In order to compensate for the standstill period of the carrier rack which occurs during the backward stroke of the carriage-like transportation element, the carrier rack is moved at far more than twice the transportation speed during the forward movement.

WO 2004 045361 A1 discloses transportation rails which can move in opposite directions to one another, run in the longitudinal direction of a conveyor-type dishwasher and are accommodated laterally in the region of the guide rails for the transportation rack. The tilting catches which rotate in the transportation direction and engage on the outer edges of the transportation rack are located on these transportation rails. These transportation rails which can move in opposite directions mean that it is possible for the respective forward stroke movement of one transportation rail to correspond to the return stroke movement of the other transportation rail. During a revolution of the drive, the transportation rails each execute two stroke cycles comprising a delivery stroke and a return stroke. By virtue of this design variant, the standstill period, which results during the backwardly-directed stroke of a rigid carriage in the customary art, can now likewise be used for the advancing movement of the transportation rack which holds the items to be cleaned.

WO 2004 019748 A1 discloses a transportation carriage whose two carriage profiles which are provided with the tilting catches which rotate in the transportation direction engage on the outer edges of the transportation rack. The drive unit of the transportation carriage is configured in such a way that the conveyor device can be moved in the forward direction, with the transportation rack moving in the forward direction on the conveyor device in relation to the treatment zones of the conveyor-type dishwasher, and the conveyor device being able to be operated in the backward direction, with the transportation rack remaining substantially stationary in relation to the treatment zones, with the speed of the backwardly directed movement of the conveyor device being considerably higher than the speed of the forward movement in the transportation direction of the items to be cleaned through the treatment zones of the conveyor-type dishwasher.

In all of the design variants of a carriage-like transportation element which are known to date, the axes of the rotatable tilting catches are arranged transverse to the longitudinal axis of the conveyor-type dishwasher, that is to say rotated through 90° with respect to the longitudinal axis of the carriage profiles. The tilting and pivoting movement of the tilting catches is therefore always directed in the direction of the transportation direction of the transportation rack through the conveyor-type dishwasher.

EP 0 917 277 A1 discloses a motor drive for driving a reciprocating transportation rail of a conveyor-type dishwasher. A rotary movement of a drive shaft is converted into a reciprocating linear movement, with a bearing comprising two half-shells of semicylindrical cross section being provided on the drive shaft. At least one of the half-shells interacts with a switching device, with the switching device switching when a certain lateral deflection of the at least one half-shell is exceeded, and in the process switching off the motor drive in particular.

Detailed analysis of the functioning of the tilting catches used to date to transport transportation racks through the treatment zones of conveyor-type dishwashers and analysis of the movement sequence of transportation catches which takes place in the space between two ribbed arrangement webs corresponding to the grid on the lower face of the transportation rack shows the following:

During the forward movement of the transportation rack which is situated on the lateral guide rails of the conveyor-type dishwasher, the upright catch which pivots in the transportation direction and is ready to engage in the grid of the transportation rack engages in the space in the grid of the transportation rack which is located above it, rests against a web and transports said web in the transportation direction of the transportation rack, that is to say in the longitudinal direction of the conveyor-type dishwasher, as far as the limit of travel of the stroke toward the front. During the subsequent backward stroke, the catch is moved in the opposite direction to the conveying direction of the transportation rack. If the tip or the back of the catch now strikes the web of the grid which is located on the lower face of the transportation rack, which web is located behind the catch, during the backward stroke, this web pushes the catch downward. In the process, the catch executes a pivoting movement in the direction of the transportation direction, for example in the clockwise direction, with the tip of the catch describing an arc of a circle. The catch remains in the dipped state until the web which is located above it releases the tip of the catch and therefore permits a backward pivoting movement, for example in the counter-clockwise direction, to the upright state of the catch. During this pivoting movement which leads to the catch being righted, the tip of the catch again describes an arc of a circle. Therefore, it is necessary for the backward stroke to be such that the catch can move from its dipped position to its upright position again. This creates a spacing between the upright tip of the catch, which is ready to engage in the space in the grid, and the web, which is located in front of said tip, of the grid which is formed on the lower face of the transportation rack, it not being possible to use said spacing to transport the transportation rack in the transportation direction of the items to be cleaned during the subsequent forward stroke. The transportation rack therefore remains stationary in relation to the treatment zone and is not moved by the conveyor device in the transportation direction of the items to be cleaned. Furthermore, this above-described spacing between the tip of the upright catch and the web, which is located in front of said tip, on the lower face of the transportation rack, which spacing cannot be used for the forward movement of the transportation rack, is called the slip.

Implemented stroke movements of between approximately 80 mm and 250 mm are known, depending on the design of the transportation mechanism. However, strokes smaller than 80 mm are not possible since the web spacing of customary ribbed arrangements which are formed on the lower face of the transportation racks is a minimum of 70 mm and it is therefore not possible to transfer the web of the ribbed arrangement from one catch to the next catch. By virtue of the slip which occurs, the stroke is therefore always greater than the web spacing of the grid which is formed on the lower face of the transportation rack.

One disadvantage of the above-described design principle of the tilting catch which pivots in the transportation direction is the fact that the forward stroke of the transportation mechanism cannot be fully used by the conveyor-type dishwasher for the forward movement of the transportation rack in the transportation direction of the items to be cleaned, and the result of this is a loss of uniformity in the movement of the carrier rack in relation to the individual treatment zones of the conveyor-type dishwasher, and this has a disadvantageous effect on the achievable washing result.

Furthermore, the washing result which is achieved depends, inter alia, directly on how long a flat spray jet from individual nozzles acts on the surface of the items to be cleaned. A non-uniform movement has a negative effect on the achievable washing result. In this context, a jerky movement (80 mm to 250 mm) of the transportation rack has a particularly disadvantageous effect, particularly within the fresh-water final rinse zone of the conveyor-type dishwasher. In the fresh-water final rinse zone, a fan-like spray jet is produced, for example, over a line transversely to the transportation direction of the transportation rack, said spray jet acting on the surface of the items be cleaned. The rinsing result on a glass which, for example, passes said linear spray jet is not satisfactory on account of the jerky movement (80 mm to 250 mm) of the transportation rack across the spray jet. In addition, jerky movements, for example the abovementioned 80 mm to 250 mm, have a negative effect on the washing result since washing liquor and final rinse water cannot be uniformly applied to the items to be cleaned.

ADVANTAGES OF THE INVENTION

In view of the cited prior art, the object of the present invention is to design the stroke movement of a transportation mechanism for the forward movement of the transportation rack to be as short as possible in order to uniformly apply both washing liquor and final rinse water to the items which are being cleaned and are stored in the transportation rack.

The advantages which can be achieved by the solution proposed according to the invention may be seen primarily in that washing liquor and final rinse water can be applied to the items to be cleaned in a far more uniform manner with the same dish capacity, that is to say quantity of dishes cleaned within a specific period, by shorter slip-free strokes, and this results in a significantly improved washing or cleaning result. Secondly, the dish capacity, that is to say the quantity of dishes cleaned within a specific period, can be increased, but with the quality of the achievable washing result remaining the same, while the cleaning parameters otherwise remain the same.

Furthermore, the use of the solution proposed according to the invention provides a short, in particular slip-free, stroke of the transportation mechanism for the forward movement of the transportation rack through the treatment zones of the conveyor-type dishwasher, in particular for the final rinse zone in which washing liquor is rinsed off using heated fresh water, it being possible to considerably reduce the quantity of fresh water which is required in particular for the purpose of final rinsing. By virtue of the short slip-free transportation strokes, firstly the heating power required to heat up this fresh water and secondly the quantity of fresh water required can be reduced. This considerably improves the cost-effectiveness and the efficiency of a conveyor-type dishwasher.

The invention proposes arranging the slip-free transportation catches which are accommodated in the transportation rails such that their rotating pivoting movement for engaging in the grid which is formed on the lower face of the transportation rack takes place transverse to the longitudinal direction of the conveyor-type dishwasher, that is to say rotated through 90° with respect to the longitudinal direction of the transportation rails. The shaft of the slip-free transportation catches is therefore always positioned in the longitudinal direction, that is to say in the transportation direction of the items to be cleaned through the conveyor-type dishwasher. The slip-free transportation catch can be supported in a U-shaped bearing shell which is firmly connected to a transportation carriage, in order to absorb the forces and torques occurring during transportation. The shaft of the slip-free transportation catch is pushed through holes in the two webs of the U-shaped bearing shell and fixed there.

A slip-free transportation catch which is located in a space between two webs of the ribbed grid which is formed on the lower face of the transportation rack functions as follows:

During the forward movement of the transportation rack which rests on guide rails which run laterally in the conveyor-type dishwasher, the upright slip-free transportation catch which pivots transverse to the transportation direction and is ready to grasp the lower face of the transportation rack bears with its front face on the web, which is located in front of it, of the grid which is formed on the lower face of the transportation rack, and transports the transportation rack in the longitudinal direction of the conveyor-type dishwasher in accordance with the conveying direction of the transportation rack until the limit of travel of the stroke in the transportation direction is reached. During the subsequent backward stroke, the slip-free transportation catch which pivots transverse to the transportation direction moves counter to the transportation direction of the transportation rack which remains stationary at this moment. If, during the backward stroke, the tip or the back of the slip-free transportation catch then strikes the web, which is located behind the slip-free transportation catch, of the ribbed grid which is formed on the lower face of the transportation rack, this web pushes the back of the slip-free transportation catch downward. On account of the way it is mounted, the slip-free transportation catch executes a pivoting movement transverse to the direction of the transportation direction of the transportation rack into a dipped position. It remains in the dipped state until the web which is located above it releases the tip of the slip-free transportation catch and therefore permits the slip-free transportation catch to pivot backwards transverse to the transportation direction into the upright state. The backward stroke of the transportation rail ends as soon as the slip-free transportation catch has righted itself. Since the slip-free transportation catch moves transverse to the transportation direction, the tip of the slip-free transportation catch rights itself, without necessarily creating a spacing, immediately after the web has passed the lower face of the transportation rack, and is now ready for the forward movement of the transportation rack without the occurrence of slip in terms of engagement on the webs which are formed on the lower face of the transportation rack. The front face of the slip-free transportation catch is therefore directly in front of the web of the transportation rack which is to be conveyed in the transportation direction, without a spacing having to be overcome in order to establish engagement with said web. The transportation rack is immediately conveyed forward in the transportation direction in a slip-free manner (without an idle stroke) during the subsequent forward stroke of the transportation rail.

If two or more slip-free transportation catches are arranged one directly behind the other, with these not being longer than the spacing between two webs, which are situated one behind the other, of a grid which is formed on the lower face of the transportation rack, very small, that is to say short, stroke movements can be achieved, and these are advantageous for the washing and final rinse result. It is particularly desirable to operate with shorter strokes when the slip-free transportation catches convey the transportation rack through the conveyor-type dishwasher since the slip, which has a negative effect, adds up as a result of each executed stroke of a transportation carriage with non-slip-free transportation catches. The greater the number of non-slip-free strokes, the more non-uniformly is the transportation rack conveyed in the transportation direction of the items to be cleaned through the conveyor-type dishwasher, and this in turn has a negative effect on the washing and final rinse result.

Given the same average speed, it is therefore better to execute shorter strokes rather than longer strokes since uniform movement of the transportation rack and therefore more uniform application of washing liquor and final rinse water to the items which are to be cleaned and are stored in the transportation rack can be achieved by stringing together a large number of short strokes. The average transportation speed is understood to be the total distance which is to be covered by the transportation rack divided by the time required to do this. In spite of the high-speed phases which occur, short transportation strokes which are executed rapidly one after the other are better for the washing and rinsing-off result since the movement as, for example, described above with reference to a glass through the final rinse zone is substantially more uniform. In the case of short strokes, a glass which is generally slender is not moved through the linear spray jet with a large stroke as in the conventional transportation methods, but in a plurality of smaller strokes, and this leads, in particular, to a significantly improved final rinse result.

DRAWING

Figure 1:
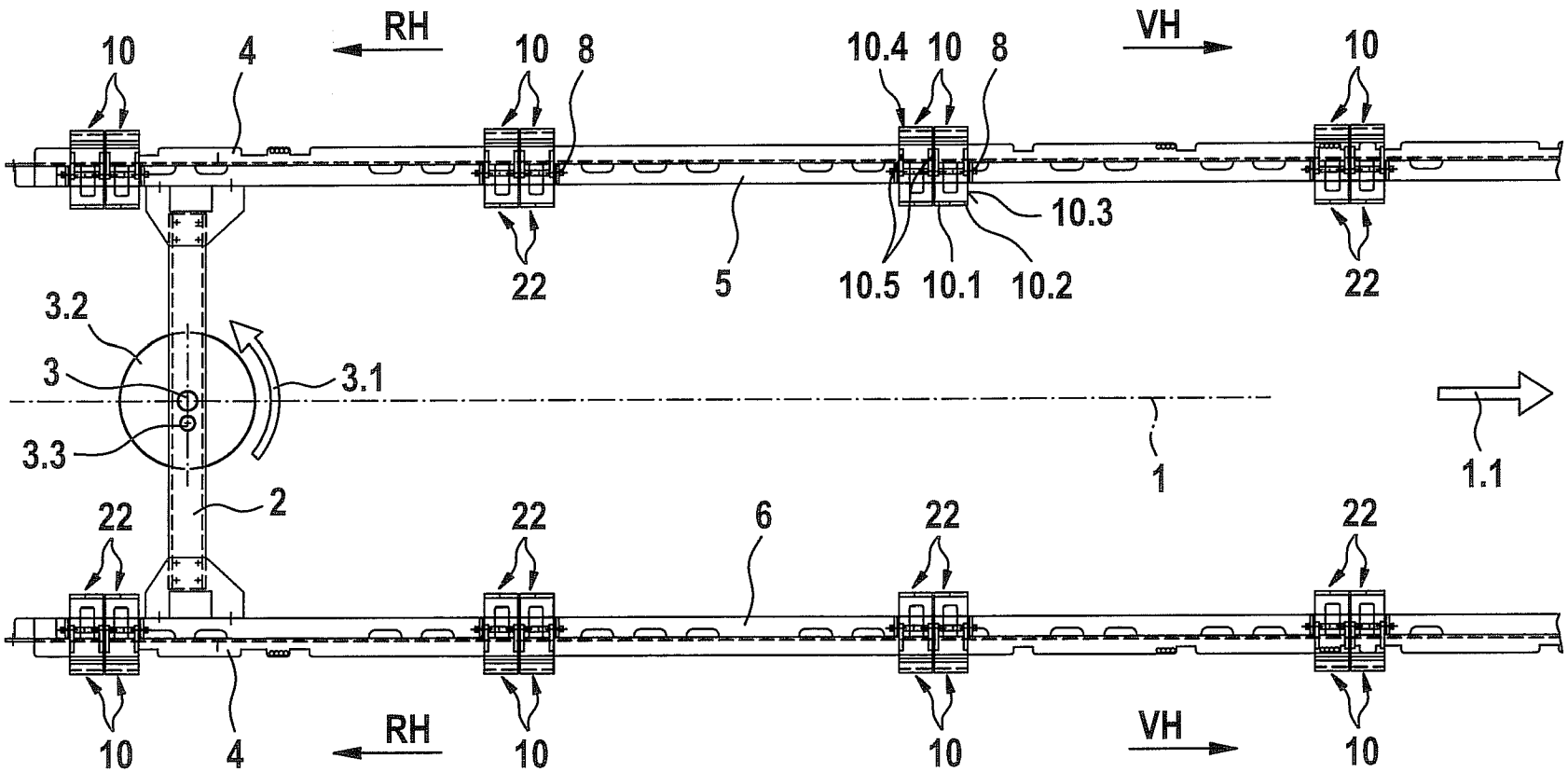
Figure 3:
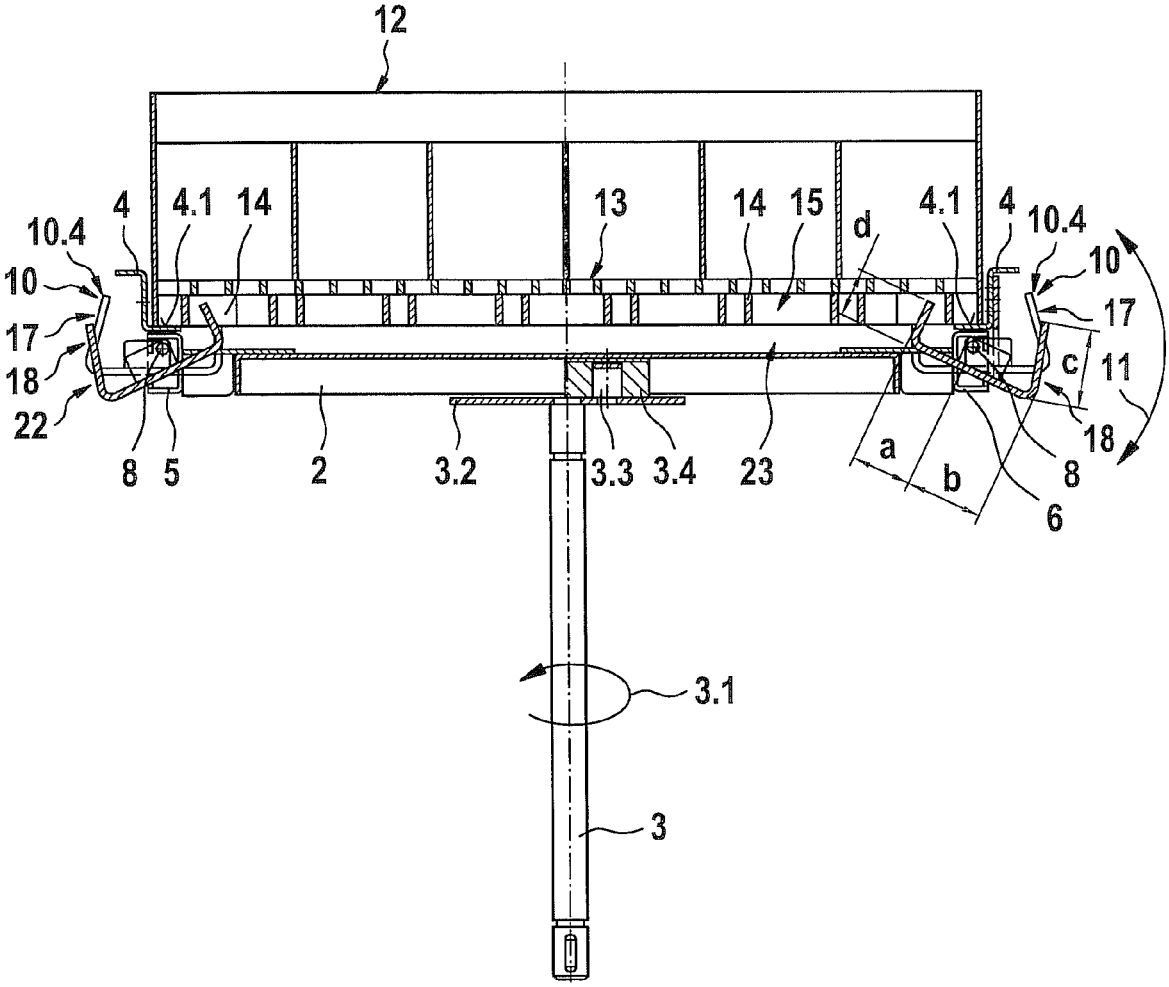

The invention is described in greater detail below with reference to the drawing, in which:

FIG. 1 shows a plan view of a carriage-like transportation frame which has slip-free transportation catches, FIG. 2 shows a side view of transportation rails with slip-free transportation catches held therein, FIG. 2.1 shows an enlarged illustration of a dipped slip-free transportation catch and a slip-free transportation catch which engages in the grid on the lower face of the transportation rack, and FIG. 3 shows a front view of the transportation rails with fitted slip-free transportation catches.

Figure 4:
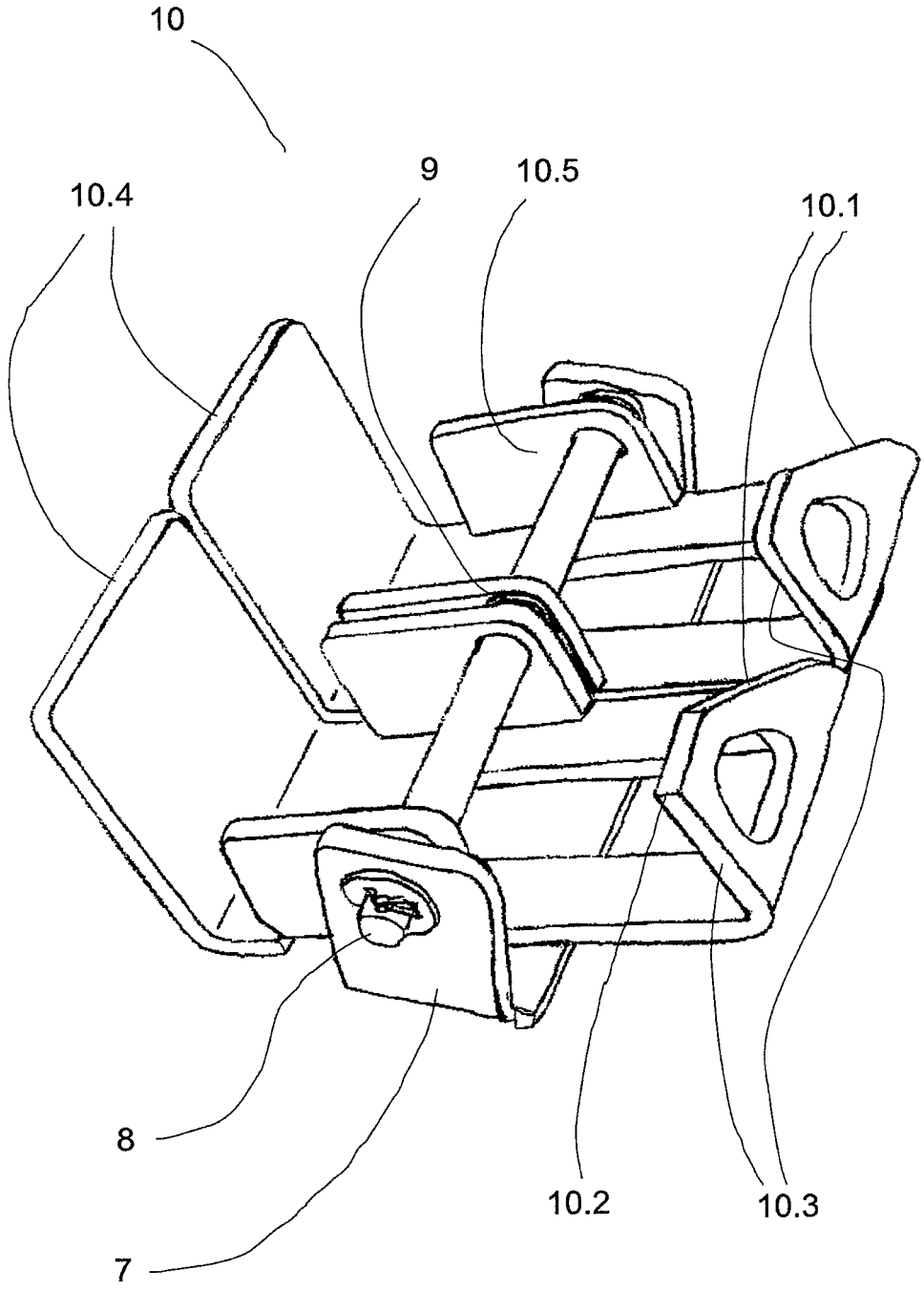

FIG. 4 shows a perspective view of a transportation catch.

EXEMPLARY EMBODIMENTS

The illustration according to FIG. 1 shows a plan view of a carriage-like transportation element for transporting a transportation rack through a conveyor-type dishwasher.

A transportation rack (not illustrated in FIG. 1) for holding items to be cleaned is transported through a conveyor-type dishwasher in the conveying direction 1.1. A conveyor device for transporting the transportation rack is of substantially carriage-like construction and formed symmetrically with respect to the axis of symmetry 1 and comprises a crossmember 2 and also two transportation rails, specifically a first transportation rail 5 and a second transportation rail 6, which are coupled by means of the crossmember 2. Rack guide rails 4 which support the transportation rack, which is transported through the treatment zones of the conveyor-type dishwasher in the conveying direction 1.1 by means of the first transportation rail 5 and the second transportation rail 6, run above the first transportation rail 5 and the second transportation rail 6.

A rotary shaft 3 which is driven by means of a drive, for example an electric drive, in the direction of rotation 3.1 is located beneath the crossmember 2. A rotary plate 3.2, which for its part holds a pin 3.3 which engages in a slide block 3.4 (not illustrated in FIG. 1), is located on the rotary shaft 3. By virtue of the illustrated technical design, the rotary movement of the driven rotary shaft 3 is converted into a reciprocating movement of the first transportation rail 5 and the second transportation rail 6 which run parallel to one another and extend in the conveying direction 1.1.

Transportation catches 10, which are in the form of slip-free tilting catches according to the invention, are held in the transportation rails 5 and 6. The individual transportation catches 10 are held in pairs (cf. reference symbol 22). The transportation catches 10 which are arranged in pairs are held in U-shaped bearings 7 (cf. the illustration according to FIG. 2.1) and can be pivoted about a shaft which extends parallel to the conveying direction 1.1 of the transportation rack, which holds the items to be cleaned, through the conveyor-type dishwasher.

The transportation catches 10 which are held in pairs can each be pivoted about a shaft 8. The transportation catches 10, which are preferably in the form of slip-free tilting catches according to the invention, comprise a back, which is identified by reference symbol 10.1, and a tip 10.2 with which said transportation catches grasp the lower face of a transportation rack (not illustrated in the illustration according to FIG. 1) and convey said transportation rack in the conveying direction 1.1 by means of an abutment face 10.3. In addition to the abutment face 10.3, the transportation catches 10 comprise a counterweight section 10.4 as is described in greater detail below. Furthermore, each transportation catch 10 is provided with a bearing flange 10.5 with which it is held on the shaft 8 such that it can pivot.

FIG. 2 shows a side view of the transportation rails with pairs of slip-free transportation catches which are held in pairs in said transportation rails.

An oscillating reciprocating movement which leads to a reciprocating movement (translatory movement) of the two transportation rails 5 and 6 which are arranged parallel to one another is imposed on the crossmember 2 in accordance with the eccentricity of the pin 3.3 in relation to the rotary shaft 3 on account of the rotation of the rotary shaft 3 in the direction of rotation 3.1 of the drive (not illustrated). The illustration according to FIG. 2 shows that a transportation rack 12 which comprises a transportation rack base 13 is guided in the rack guide rail 4. A ribbed transportation arrangement 23, which exhibits firstly ribs 14 which run perpendicular to the plane of the drawing according to FIG. 2 and secondly spaces 15 which are each bounded by ribs 14, is located beneath the transportation rack base 13.

As seen in the conveying direction 1.1 of the transportation rack 12, pairs 22 of transportation catches 10 are located on the second transportation rail 6, which is illustrated in side view in FIG. 2, such that they are spaced apart from one another. The illustration according to FIG. 2 shows that, in the state of the transportation catch 10 illustrated in FIG. 2, the tip 10.2 of said transportation catch engages in a space 15 between two webs 14 on the ribbed transportation arrangement 23 on the lower face of the transportation rack 12. The further transportation catch 10 which is associated with the pair 22 of transportation catches is returned counter to the torque, which is exerted on each transportation catch 10 by the elongate counterweight section 10.4, precisely by a web 14 of the ribbed transportation arrangement 23.

In this snapshot, the transportation rack 12 illustrated in FIG. 2 is conveyed in the conveying direction 1.1 precisely by the part, which enters the space 15 in the ribbed transportation element 23, of the transportation catch 10, which is preferably in the form of a slip-free tilting catch, specifically the abutment face 10.3 beneath the tip 10.2.

The illustration according to FIG. 2.1 shows an enlarged illustration of a dipped transportation catch and a transportation catch which engages in the ribbed transportation arrangement of the transportation rack.

The illustration according to FIG. 2.1 shows that one of the transportation catches 10 is located in its upright position 17, whereas the other transportation catch 10 of the pair 22 of transportation catches is located in its dipped position 18. The two transportation catches 10 of the transportation catch pair 22 are held on the shaft 8 which is held in the U-shaped bearing 7. The U-shaped bearing 7 is arranged in an aperture 16 in the wall of the second transportation rail 6. The shaft 8, on which the transportation catches 10 are held, is mounted by means of spacers 9. The forces and torques which occur during transportation of the transportation rack 12 in the conveying direction 1.1 are absorbed by means of the U-shaped bearing 7.

The transportation catch 10, which has assumed its position 17 which is upright in relation to the ribbed transportation arrangement 23 in the illustration according to FIG. 2.1, reaches this position on account of the counterweight section 10.4 (cf. the illustration according to FIG. 3 too) which is higher. A torque acts on the components 10.1 and 10.2 of each transportation catch 10 in the upright position in relation to the rotary shaft 8 on account of the counterweight section 10.4, which is higher, of each of the transportation catches 10 which are designed as slip-free tilting catches. During the forward movement of the transportation rack 12 on the rack guide rails 4 which run laterally in the conveyor-type dishwasher, the transportation catch 10, which pivots transverse to the conveying direction 1.1 and assumes its upright position 17, bears with its abutment face 10.3 on the web 14, which is located in front of it, of the ribbed transportation arrangement 23 which is formed on the lower face of the transportation rack 12, and pushes the transportation rack in the longitudinal direction of the conveyor-type dishwasher, that is to say in the conveying direction 1.1 as far as the limit of travel of the stroke of the second transportation rail 6.

During the subsequent backward stroke counter to the conveying direction 1.1 of the second transportation rail 6, the transportation catch 10 which pivots transverse to the conveying direction 1.1 is moved counter to the conveying direction 1.1 of the transportation rack 12 which remains stationary at this moment. If, during the backward stroke counter to the conveying direction 1.1, the back 10.1 of the transportation catch 10 strikes the web 14, which is located behind the transportation catch 10, of the ribbed transportation arrangement 23 which is formed on the lower face of the transportation rack 12, this web 14 pushes the back 10.1 of the transportation catch 10 downward. On account of the way it is mounted on the shaft 8, the transportation catch 10, which is preferably in the form of a slip-free tilting catch, executes a pivoting movement transverse to the conveying direction 1.1. The transportation catch 10 remains in its dipped position 18 until the web 14 which is located above it releases the tip 10.2 of the transportation catch 10 and therefore permits the transportation catch 10 to pivot backward transverse to the conveying direction 1.1 into the upright position 17.

The backward stroke of the second transportation rail 6 ends as soon as the transportation catch 10 has righted itself. Since the transportation catch 10 moves transverse to the conveying direction 1.1, the tip 10.2 of the transportation catch 10 rights itself, without necessarily creating a spacing, immediately after the web 14, which is pushing it down, of the ribbed transportation arrangement 23 has passed the lower face of the transportation rack 12, and is therefore ready to engage without a slip for a forward movement of the transportation rack 12 in the conveying direction 1.1. The abutment face 10.3 of the slip-free transportation catch 10 according to the invention is therefore directly, that is to say without a spacing from the web 14 having to be adopted, just in front of this web 14 of the transportation rack 12 which is to be conveyed in the conveying direction 1.1. The transportation rack 12 is immediately conveyed forward in the conveying direction 1.1 in a slip-free manner during the subsequent forward stroke of the second transportation rail 6.

By arranging two or more transportation catches 10 one directly behind the other, with this entire arrangement not being longer than the spacing between two webs 14, which are situated one behind the other, of the ribbed transportation arrangement 23 on the lower face of the transportation rack 12, very small, that is to say short, strokes can be achieved for the advancing movement of the transportation rack 12, said strokes being advantageous for the washing and final rinse result.

The use of short-stroke techniques, that is to say to transport transportation racks 12 in the conveying direction 1.1 with relatively short strokes, is particularly expedient when the transportation catches 10 convey the transportation rack 12 through the conveyor-type dishwasher in a slip-free manner, since the slip, which has a negative effect, adds up as a result of each executed stroke of a transportation carriage with non-slip-free transportation catches. The solutions according to the prior art result in increasing non-uniformity in the transportation movement of the transportation rack 12 in the conveying direction 1.1 on account of the accumulating standstill period of the transportation rack 12.

The greater the number of short non-slip-free strokes, the more non-uniformly is the transportation rack conveyed in the conveying direction 1.1, and this has a negative effect on the achievable washing and final rinse result.

Given the same average speed, it is therefore highly advantageous to execute short strokes rather than longer strokes in order to move the transportation rack 12 since more uniform movement of the transportation rack 12 and therefore more uniform application of both washing liquor and final rinse water to the items which are to be cleaned and are contained in said transportation rack can be achieved by stringing together a large number of short strokes. The average transportation speed is understood to be the total distance which the transportation rack 12 has to cover divided by the time required to do this.

In spite of the high-speed phases which occur, short transportation strokes, which are executed rapidly one after the other, for moving the transportation rack 12 in the conveying direction 1.1 are better for the washing and rinsing-off result since, for example, a glass is moved more uniformly. In the case of short strokes, this means that a slender glass is not transported across the linear spray jet in the final rinse zone with one stroke as in the conventional conveying methods known from the prior art, but that a plurality of small strokes are used for this purpose in accordance with the suggestion proposed according to the invention, and this leads to wetting of the slender glass, which is singled out and cited as an example, with final rinse water being considerably improved.

The illustration according to FIG. 3 shows a front view of the transportation rails with fitted transportation catches which are preferably in the form of slip-free tilting catches.

The illustration according to FIG. 3 shows that the rotary plate 3.2 of the rotary shaft 3 which rotates in the direction of rotation 3.1 holds the pin 3.3 which is arranged eccentrically with respect to the rotary shaft 3. The pin operates a slide block 3.4 which, for its part, is held in the crossmember 2 by means of which a reciprocating movement, which takes place perpendicular to the plane of the drawing according to FIG. 3, is imposed on the first transportation rail 5 and the second transportation rail 6.

The transportation rack 12 which is illustrated in FIG. 3 shows the ribbed transportation arrangement 23, which is formed on the lower face of said transportation rack, and also the individual ribs 14, which run in the plane of the drawing, on the lower face of the transportation rack base 13. The ribbed transportation arrangement 23 of the transportation rack 12 rests on supporting faces 4.1 of the rack transportation rails 4 which extend perpendicular to the plane of the drawing.

Beneath the supporting faces 4.1 of the rack guide rails 4, the first transportation rail 5 and the second transportation rail 6 run perpendicular to the plane of the drawing according to FIG. 3. The illustration according to FIG. 3 shows that pairs 22 of transportation catches 10 are arranged both in the first transportation rail 5 and in the second transportation rail 6. The transportation catches 10, which are illustrated in their upright position 17 and, respectively, in their dipped position 18 both on the first transportation rail 5 and on the second transportation rail 6, can be pivoted about the shafts 8 which are held in U-shaped bearings 7 which can be seen in FIG. 2.1. The illustration according to FIG. 3 shows that each transportation catch 10 exhibits a first lever arm a and a second lever arm b in relation to its mounting and pivot point on the shaft 8. The back 10.1 and the tip 10.2 and the abutment face 10.3 (not illustrated in FIG. 3) are held on the first lever arm a. The height of the transportation catch 10 on this side is identified by reference symbol d. The counterweight section 10.4, which is substantially higher compared to the height d of the opposite side of the transportation catch 10 and has a height c, is located at the end of the second lever arm b of each transportation catch 10. By virtue of this geometry of the transportation catches 10, a torque is exerted on the transportation catch 10 on account of the longer lever arm of the second lever arm b and the greater height of the counterweight section 10.4, specifically height c, and this enables the transportation catch 10 to move in the free spaces in the ribbed transportation arrangement 23 which is formed on the lower face of the transportation rack 12. The transportation catch 10 is deflected from its upright position 17 to its dipped position 18 as a result of the back section 10.1 running onto a web 14 on the ribbed transportation arrangement 23 (cf. the illustration according to FIG. 2.1) during the backward movement of the respective transportation rail 5 or 6. The pivoting movement of the transportation catches 10 about the shaft 8 is identified by the double-headed arrow denoted by reference symbol 11.

The crossmember 2 which is driven by means of the rotary shaft 3 and is illustrated in FIG. 3 is coupled to the transportation rails which extend perpendicular to the plane of the drawing according to FIG. 3, that is to say to the first transportation rail 5 and the second transportation rail 6, and imposes a reciprocating movement, which runs in the plane of the drawing, on the first transportation rail 5 and the second transportation rail 6. It goes without saying that, in accordance with the proposed invention, not only a single transportation rack but a large number of transportation racks 12 which are arranged one behind the other and are filled with items to be cleaned can be transported using short-stroke techniques particularly through the treatment zone of the conveyor-type dishwasher, which zone is in the form of a final rinse zone or fresh-water final rinse zone, with uniform wetting, in particular of items which are problematical to clean, for example slender glasses, being ensured.

LIST OF REFERENCE SYMBOLS

1 Axis of symmetry
1.1 Conveying direction
2 Crossmember
3 Rotary shaft
3.1 Direction of rotation of the drive
3.2 Rotary plate
3.3 Pin
3.4 Slide block
4 Rack guide rail
4.1 Supporting face for transportation rack
5 First transportation rail
6 Second transportation rail
7 U-shaped bearing
8 Shaft (pivot shaft)
9 Spacer
10 Transportation catch (slip-free tilting catch)
10.1 Back
10.2 Tip
10.3 Abutment face
10.4 Counterweight section
10.5 Bearing flange
11 Pivoting movement of the transportation catch 10
12 Transportation rack
13 Transportation rack base
14 Web
15 Web space
16 Aperture in the transportation rail wall
17 Upright position of the transportation catch 10
18 Dipped position of the transportation catch 10
19 Bearing plate
20 Securing plate
21 Sliding bearing block
22 Transportation catch pair
23 Ribbed transportation arrangement on the transportation rack 12
a First lever arm
b Second lever arm
c Height of the counterweight section 10.4
d Height of the back 10.1
VH Advancing stroke
RH Return stroke

The invention claimed is:

1. A conveyor-type dishwasher for cleaning items as they are conveyed comprising:

a plurality of treatment zones;

at least one guide rail for guiding transportation racks in a conveying direction, the transportation racks holding items to be cleaned; and transportation rails which are driven and on which transportation catches are held, the transportation catches being configured to grasp webs projecting from bottoms of the transportation racks, wherein the transportation catches are mounted such that they are pivotable on rotary shafts which are oriented parallel to the conveying direction of the transportation rack for engaging and disengaging the webs.

2. The conveyor-type dishwasher as claimed in claim 1, wherein the transportation catches are designed as slip-free tilting catches.

3. The conveyor-type dishwasher as claimed in claim 1, wherein the transportation catches are arranged in pairs on the transportation rails, or a plurality of transportation catches are arranged one behind the other in the conveying direction.

4. The conveyor-type dishwasher as claimed in claim 3, wherein a space between webs of a transportation conveying arrangement of the transportation rack is shorter, as seen in the conveying direction, than a pair of transportation catches or a plurality of transportation catches which are situated one behind the other as seen in the conveying direction.

5. The conveyor-type dishwasher as claimed in claim 1, wherein the transportation catches are held in a U-shaped bearing in apertures in the wall of the transportation rails.

6. The conveyor-type dishwasher as claimed in claim 1, wherein the transportation catches have a section which engages in a ribbed transportation arrangement, and a counterweight section.

7. The conveyor-type dishwasher as claimed in claim 6, wherein the section which grasps the ribbed transportation arrangement has a lower height than the height of the counterweight section of the transportation catch.

8. The conveyor-type dishwasher as claimed in claim 6, wherein the section of the transportation catch, which section grasps the ribbed transportation arrangement, is held on a first lever arm in relation to the shaft, said first lever arm being shorter than the second lever arm on which the counterweight section is held.

9. The conveyor-type dishwasher as claimed in claim 6, wherein the section of the transportation catch which grasps the ribbed transportation arrangement has an abutment face and a back.

10. The conveyor-type dishwasher as claimed in claim 9, wherein the back has a slope which runs onto a closest web of the ribbed transportation arrangement during a return stroke of the transportation rails and moves the transportation catch from an upright position to a dipped position.

* * * * *